US006198084B1

(12) United States Patent
Kim

(10) Patent No.: US 6,198,084 B1
(45) Date of Patent: Mar. 6, 2001

(54) DEFROSTING METHOD FOR A MICROWAVE OVEN USING AN INFRARED SENSOR

(75) Inventor: Won-ho Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/429,918

(22) Filed: Oct. 29, 1999

(30) Foreign Application Priority Data

Jul. 12, 1999 (KR) ..... 99-27971

(51) Int. Cl.[7] ..... H05B 6/68

(52) U.S. Cl. ..... 219/703; 219/711; 99/325; 426/241; 426/524

(58) Field of Search ..... 219/703, 711, 219/710, 718, 704, 705; 99/325, DIG. 14; 426/241, 243, 524

(56) References Cited

U.S. PATENT DOCUMENTS 5,545,880 * 8/1996 Bu et al. ..... 219/703
6,013,907 * 1/2000 Lee ..... 219/703

FOREIGN PATENT DOCUMENTS 58-110929 * 7/1983 (JP) ..... 219/711
62-169937 * 7/1987 (JP) ..... 219/703
5-39929 * 2/1993 (JP) ..... 219/703

* cited by examiner

*Primary Examiner*—Philip H. Leung
(74) *Attorney, Agent, or Firm*—Robert E. Bushnell, Esq.

(57) ABSTRACT

Defrost method for accurately defrosting food to be defrosted, regardless of frozen degree and presence/absence of receptacle for food to be defrosted. The defrosting method includes the steps of: determining an initial value by detecting a surface temperature of food to defrost; determining a defrost completion value in accordance with the initial value which is determined in the step of determining the initial value; detecting a current value of an infrared sensor at a regular time basis while driving a magnetron; and completing the defrosting process if the current value reaches the completion value. An output value of the infrared sensor is detected at a predetermined regular time basis while a rotatable tray for placing the food is rotated, and the initial value is obtained from the lowest output value among a plurality of output values which are detected. A gap between the initial value and the completion value is divided into at least two divisions, and a power rate of the magnetron is varied in accordance with the respective divisions. The power rate of the magnetron of the respective divisions, is decreased from the value which is closer to the initial value to the value which is closer to the completion value.

20 Claims, 5 Drawing Sheets

DEFROSTING METHOD FOR A MICROWAVE OVEN USING AN INFRARED SENSOR

CLAIM OF PRIORITY

This application makes reference to, incorporates the same herein, and claims all benefits accruing under 35 U.S.C. §119 from an application entitled DEFROSTING METHOD USING INFRARED SENSOR FOR MICRO WAVE OVEN earlier filed in the Korean Industrial Property Office on Jul. 12, 1999 and there duly assigned Ser. No. 27971/1999.

BACKGROUND OF THE INVENTION

1. Field of the Invention

The present invention relates to a microwave oven for cooking food by using high frequency microwaves which are generated from a magnetron, and more particularly to a defrosting method for a microwave oven for sensing a temperature of the food by using an infrared sensor and for determining a defrost completion time in accordance with the detected temperature of the food.

2. Description of the Prior Art

Generally, a microwave oven is an appliance for cooking food by using high frequency microwaves which are generated from a magnetron. Such a microwave oven is widely used due to its advantages such as high heat efficiency, quick cooking process, and less loss of nutrients.

The conventional microwave oven is shown in FIG. 1, in which the microwave oven includes a body 10, and cooking and device chambers 12 and 14 formed within the body 10. The food to be cooked is placed in the cooking chamber 12, while the cooking chamber 12 is opened/closed by a door 20 mounted on the front side thereof.

The cooking chamber 12 further includes a rotatable plate 16 for placing food, which is arranged on the bottom side of the cooking chamber 12. The device chamber 14 includes various devices for generating and emitting the high frequency microwaves into the cooking chamber 12, such as a magnetron 17, a high voltage transformer 18, a wave guide (not shown), and a cooking fan 19, etc.

On the front side of the device chamber 14, an operation panel 30 is formed, through which a user inputs cooking operational commands. The food is cooked in accordance with the commands inputted through the operation panel 30 by a control part (not shown) which is formed on a rear side of the operation panel 30 for controlling the respective operations of the devices.

When the devices of the device chamber 14 are operated, the high frequency microwaves generated from the magnetron 17 are guided through the wave guide into the cooking chamber 12. The high frequency microwaves guided into the interior of the cooking chamber 12 are emitted to the food directly, or indirectly by being reflected against the walls of the cooking chamber 12.

The high frequency microwave which is emitted to the food, vibrates the water molecules contained within the food and generates the heat for cooking the food. In addition to the cooking operation, the microwave oven is further used for defrosting frozen food, or for warming liquid such as water, or beverages.

Particularly when defrosting frozen food, the high frequency microwave is emitted to the frozen food for a predetermined time, which is set in accordance with the weight of the frozen food. A method for defrosting food by a conventional microwave oven is described below with reference to the flow chart shown in FIG. 2.

First, the weight of the frozen food is measured (Step S1). In the past, the weight of the food has been directly inputted by the user's estimation through a keypad of the operation panel 30. Recently, however, the weight of the food can be measured by a weight sensor.

After measuring the weight of the food, the defrosting time is set in accordance with the measured weight of the food (Step S2). Next, the magnetron 17 is operated for a predetermined time (Step S3). When the predetermined time elapses (Step S4), the magnetron 17 is stopped and the defrosting process is completed (Step S5).

The conventional defrosting method for the microwave oven, however, has the following drawbacks:

Usually, the user places frozen food in the receptacle before the defrosting process, in order to prevent the water, which is generated out of the food during the defrosting process, from dropping onto the rotatable plate 16. In this case, the weight sensor, which is employed in the microwave oven, recognizes the total weight of the food and the receptacle as the weight of the food.

Accordingly, the defrosting time is inaccurately set. As a result, the problem arises in the accuracy of food cooking time in that the food is partially overheated, or the like.

Further, according to the conventional defrosting method, the magnetron 17 is driven for the predetermined time which is set in accordance with the weight of the food.

This means that foods having a temperature of −20 Celsius degree or −5 Celsius degree may undergo the same defrosting process for the same period of time, only if the weights thereof are the same as each other. Accordingly, the food can not be defrosted accurately.

SUMMARY OF THE INVENTION

The present invention has been developed to overcome the above-mentioned problems of the prior art, and accordingly, it is an object of the present invention to provide a method for a microwave oven for consistently defrosting food accurately, regardless of the frozen degree of the food, or the presence/absence of the receptacle.

The above object is accomplished by a defrosting method for a microwave oven according to the present invention, including the steps of: determining an initial value by detecting a surface temperature of food to defrost; determining a defrost completion value in accordance with the initial value which is determined in the step of determining the initial value; detecting a current value of an infrared sensor on a regular time basis while driving a magnetron; and completing the defrosting process if the current value reaches the completion value.

In the step of determining the initial value, an output value of the infrared sensor is detected at a predetermined regular time basis while a rotatable tray for placing the food is rotated, and the initial value is obtained from the lowest output value among a plurality of output values which are detected.

In the step of driving the magnetron, a gap between the initial value and the completion value is divided into at least two divisions, and a power rate of the magnetron is varied in accordance with the respective divisions.

In the step for detecting the current value, the output value of the infrared sensor is detected at a predetermined regular time basis while the rotatable tray for placing the food is rotated, and the current value is obtained from the lowest output value among the output values which are detected.

The power rate of the magnetron of the respective divisions, is decreased from the value which is closer to the initial value to the value which is closer to the completion value.

According to the present invention, the microwave oven is controlled by using output value of the sensor corresponding to the surface temperature of food to be defrosted. Accordingly, the defrosting can be accurately performed, regardless of the frozen degree of the food, and presence/absence of the receptacle for food.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

In order to determine the completion of the defrosting process, the present invention employs an infrared sensor for detecting the surface temperature of the food, and outputting a corresponding voltage value.

Figure 4:
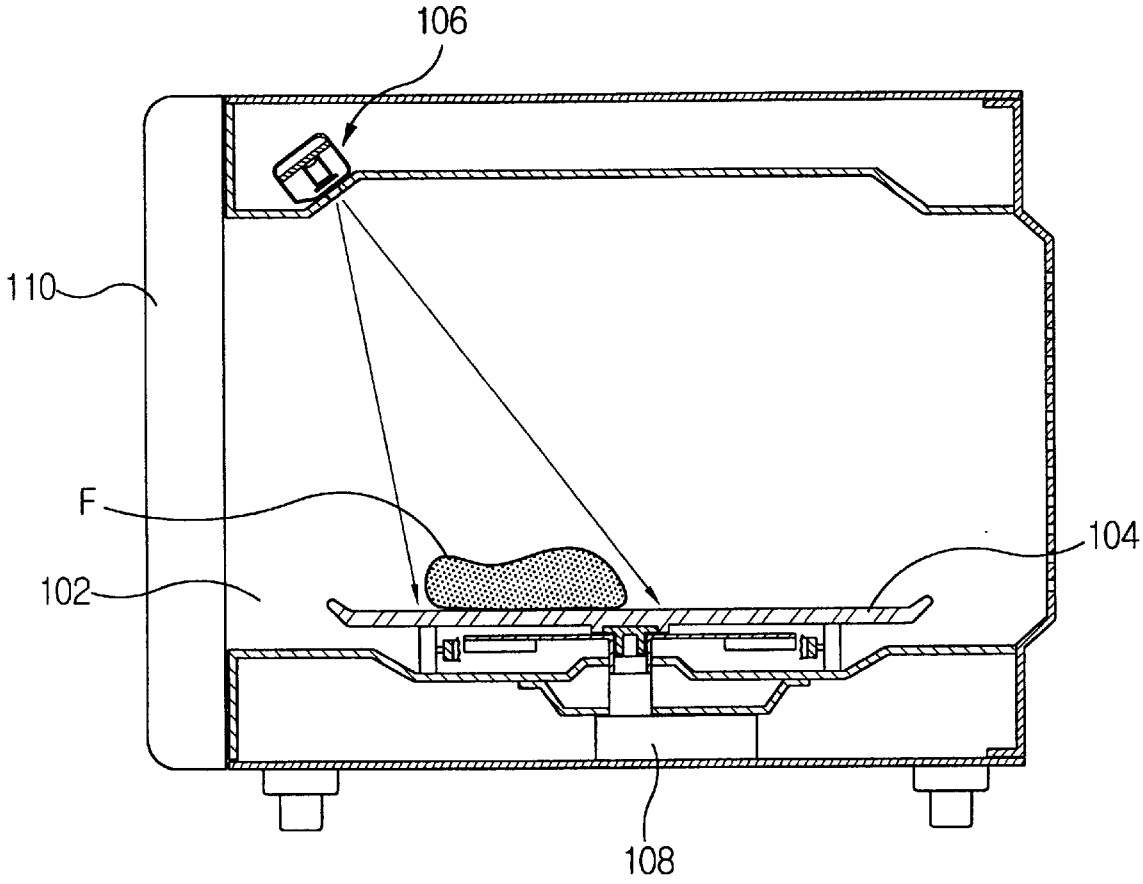
FIG. 4 is a sectional view of the microwave oven employing the infrared sensor to establish the defrosting method according to the preferred embodiment of the present invention.

As shown in FIG. 4, the infrared sensor 106 is formed on the upper front side of the cooking chamber 102 of the microwave oven, to detect the surface temperature of the food F placed within the detection spots Sp (See FIG. 5) occupying a predetermined area of the rotatable plate 104.

Undesignated reference numeral 108 in FIG. 4 refers to a driving motor for rotating the rotatable plate 104, and 110 refers to a door for opening/closing the cooking chamber 102.

The defrosting method according to the preferred embodiment of the present invention includes a step for controlling the driving of the magnetron in accordance with the voltage value which is outputted from the infrared sensor 106 corresponding to the surface temperature of the food F placed within the detection spots Sp.

Figure 1:
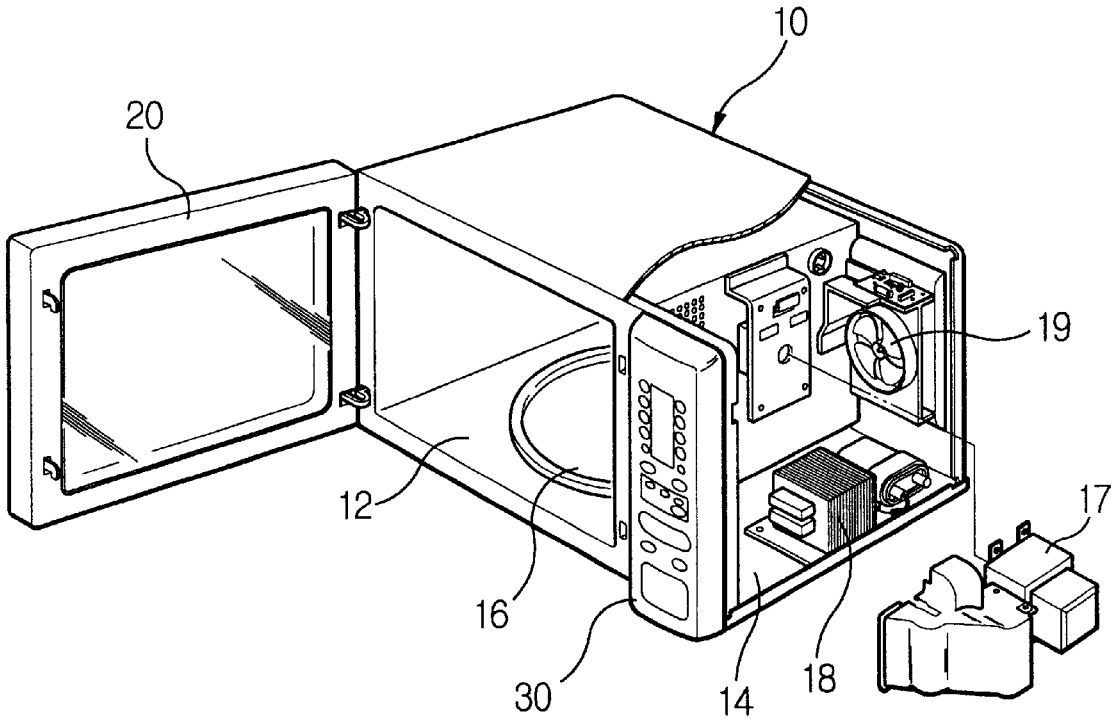
FIG. 1 (PRIOR ART)
FIG. 1 is a perspective view of a conventional microwave oven.
Figure 2:
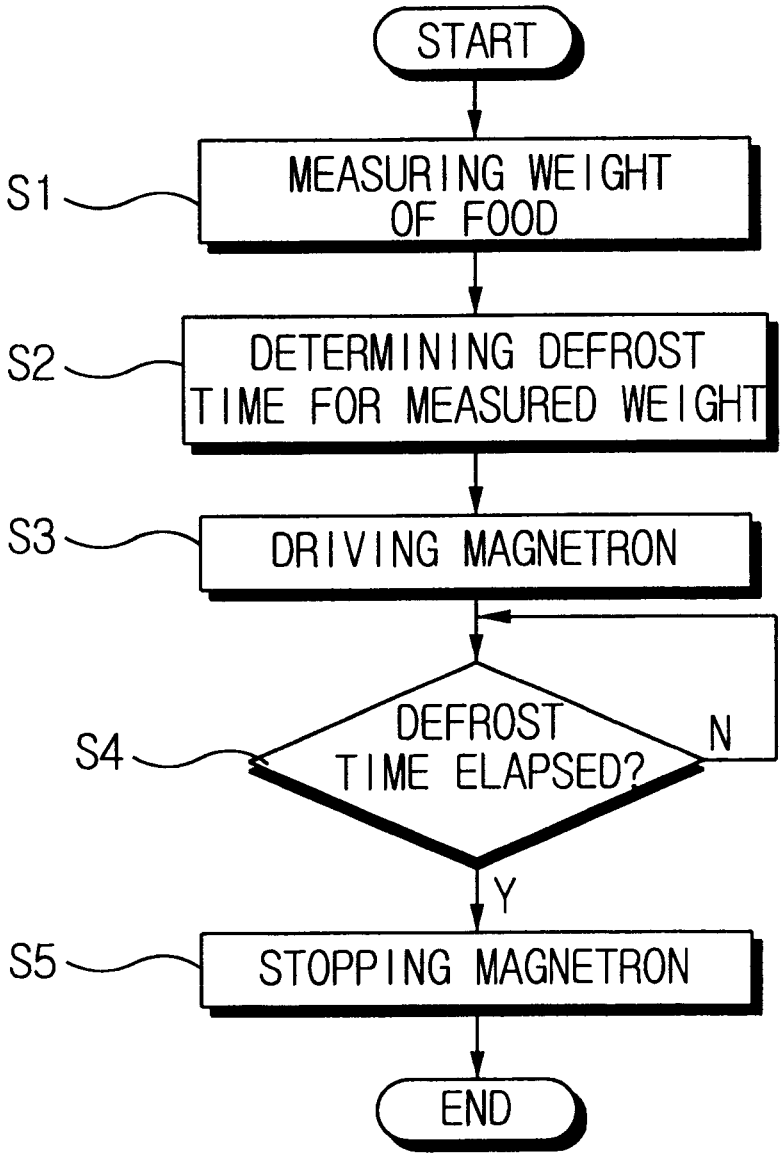
FIG.2 (PRIOR ART)
FIG. 2 is a flow chart for explaining the defrosting method for a conventional microwave oven employing a weight sensor.
Figure 3:
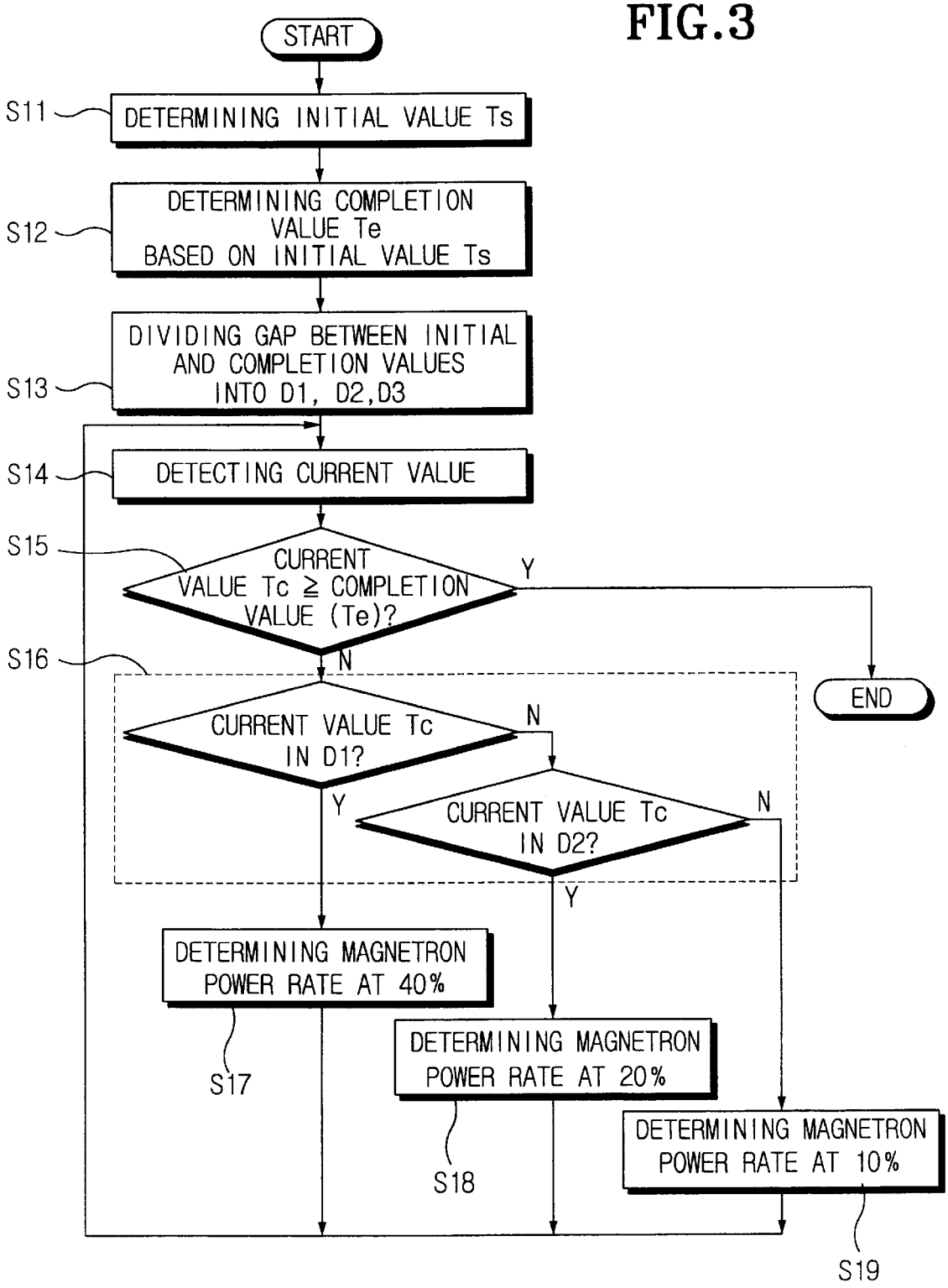
FIG. 3 is a flow chart for explaining the defrosting method for a microwave oven employing an infrared sensor according to the preferred embodiment of the present invention.

Hereinafter, the preferred embodiment of the present invention will be described in greater detail with reference to FIG. 3, which shows the flow chart for illustrating such a defrosting method.

First, an initial value Ts of the infrared sensor 106 is established (Step S11). Here, the initial value Ts obtained in S11 corresponds to the initial surface temperature of the frozen food F.

Here, the infrared sensor 106 outputs the voltage value corresponding to the average temperature of the area occupied by the detection spots Sp. Accordingly, the voltage value varies depending on the size of the frozen food F and the position of the frozen food F with respect to the rotatable plate 104.

Figure 5:
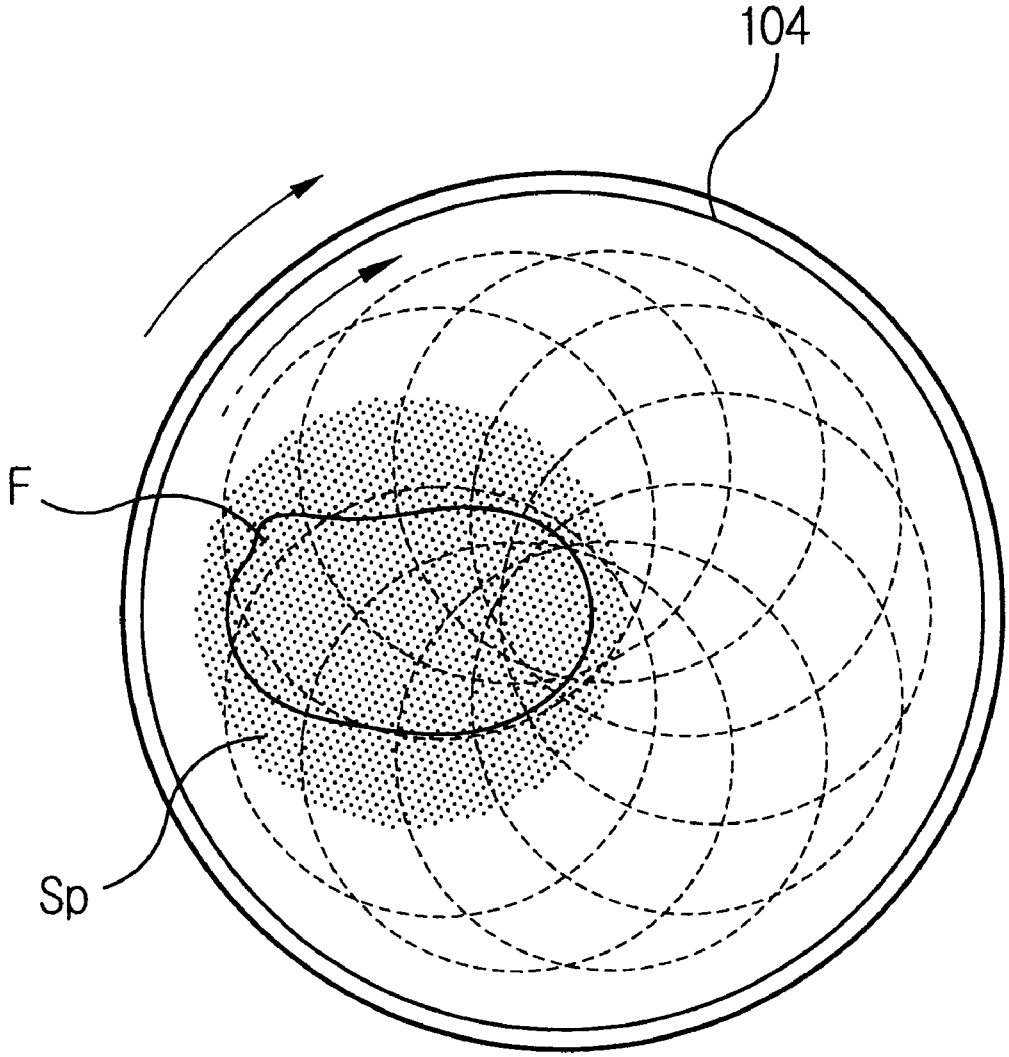
FIG. 5 is a plan view for explaining the defrosting method according to the preferred embodiment of the present invention and for determining an initial value of the infrared sensor.

More specifically, when the frozen food F is small and moves from the center of the rotatable plate 104, as shown in FIG. 5, the food F and the part of the upper side of the rotatable plate 104 are simultaneously occupied by the detection spots Sp.

In such a situation, the output value of the infrared sensor 106 corresponds to the average temperature of the surface temperature of the food F and the temperature of the upper side of the rotatable plate 104.

The problem is that the surface temperature of the food F (−20° C. to −5° C. in general) and the temperature of the upper side of the rotatable plate 104 (higher than room temperature) have a wide gap therebetween.

Accordingly, the output value of the infrared sensor 106, which is obtained from the average temperature of the surface temperature of the food F and the temperature of the upper side of the rotatable plate 104, is different from the actual surface temperature of the food F.

The larger the area of the food F occupied by the detection spots Sp, the more accurate the output value of the infrared sensor 106 becomes with respect to the actual surface temperature of the food F.

According to the preferred embodiment of the present invention, the detection spots Sp of the infrared sensor 106 are made to occupy a certain area of the upper side of the rotatable plate 104, and the output value of the infrared sensor 106 is detected for a predetermined time period—preferably while the rotatable plate 104 is rotated twice—, and detected on a regular basis such as detected every second, or every two seconds. Then the lowest output value of the infrared sensor 106 is determined as the initial value of the infrared sensor 106.

When the detection spots Sp are made to occupy a certain predetermined area of the upper side of the rotatable plate 104, the detection spots Sp occupy respective parts of the upper side of the rotatable plate 104 in a circular movement along the rotatable plate 104.

Accordingly, as the detection spots Sp are circularly moving along the upper side of the rotatable plate 104, the area of the food F and the area of the upper side of the rotatable plate 104 are occupied by the detection spots Sp in different proportions.

Here, the output value of the infrared sensor 106, which is detected when the largest area of the food F is occupied by the detection spots Sp, is closest to the actual initial surface temperature of the food.

Further, since the temperature of the upper side of the rotatable plate 104 is higher than the surface temperature of the food F, the average temperature becomes lower when more area of the food F is occupied by the detection spots Sp. As the average temperature becomes lower, the output value of the infrared sensor 106 becomes lower.

Accordingly, the lowest value of the output values of the infrared sensor 106 is the closest value with respect to the actual initial surface temperature of the food F.

After determining the initial value Ts of the infrared sensor 106, the completion value Te is determined to determine the time when the defrosting process is completed (Step S12).

The completion values Te are pre-stored in the memory, which is employed in the control part for controlling the operation of the microwave oven. Below Table 1 shows the respective completion values Te varying in accordance with the initial values Ts of the infrared sensor 106, according to the preferred embodiment of the present invention.

TABLE 1

| | | | | | | | |
|---|---|---|---|---|---|---|---|
| Initial output value Ts of infrared sensor | | 59–60 | 61 | 62 | 63–64 | 65–66 | 67–68 |
| Completion value Te of infrared sensor | | 69 | 70 | 71 | 72 | 73 | 74 |
| Power rate for divisions | D1 (40%) | 59, 60–62 | 61–63 | 62–64 | 63, 64–65 | 65, 66–67 | 67, 68–69 |
| | D2 (20%) | 63–66 | 64–66 | 65–67 | 66–68 | 68–69 | 70–71 |
| | D3 (10%) | 66–68 | 67–69 | 68–70 | 69–71 | 70–72 | 72–73 |

In the above Table 1, the respective figures without the measurement unit are integers which are converted from the voltages detected by the infrared sensor 106 based on a predetermined standard.

As shown in the above Table 1, the initial value Ts of the infrared sensor 106 ranges from 59 to 68 and corresponds to the surface temperature of the food F which approximately ranges from −20° C. to −2° C. The corresponding completion value Te ranges from 69 to 74, corresponding to the defrost completion temperature which approximately ranges from −0° C. to 10° C.

As described above, the completion value Te varies depending on the initial values Ts of the infrared sensor 106. This is to prevent the inaccurate defrosting of the food F due to the short defrosting time. If the completion value Te is set at a uniform degree, the defrosting time may be shortened when the initial value Ts has a narrow gap with the completion value Te.

Here, the output value of the infrared sensor 106 corresponding to the temperature of the food F may be varied depending on the types of the infrared sensor 106.

After the initial value Ts of the infrared sensor 106 corresponding to the initial surface temperature of the food F, and the completion value Te corresponding to the initial value Ts, are respectively determined, the magnetron is driven while the current value Tc of the infrared sensor 106, which corresponds to the surface temperature of the food F, is detected on a regular basis, until the current value Tc reaches the completion value Te.

Meanwhile, as a result of experiments by the inventor, it was found that the food F defrosts more efficiently when the defrosting process is started with a stronger power of the magnetron and ends with less power. Accordingly, such a principle is employed in the preferred embodiment of the present invention, which will be described in greater detail as follows:

First, the gap between the initial value Ts and the completion value Te is divided into three divisions, D1, D2, and D3. Like the completion values Te, the ranges of the three divisions D1, D2, and D3 are pre-stored in the memory of the controlling part.

Accordingly, when the initial value Ts is detected, the ranges of the three divisions D1, D2, and D3 are determined by reading those that correspond to the initial value Ts from the memory of the control part.

According to the above Table 1, when the initial value Ts of the infrared sensor 106 is 60, the completion value Te is 69, and the ranges of the three divisions D1, D2, and D3 are 60–62, 63–65, and 66–69, respectively.

After the ranges of the divisions D1, D2, and D3 are obtained in accordance with the initial value Ts of the infrared sensor 106, the current value Tc of the infrared sensor 106 is detected (Step S14).

The current value Tc of the infrared sensor 106 corresponds to the current surface temperature of the food F in the defrosting process, and is detected by the same method that is employed for detecting the initial value Ts in S11.

Here, the difference lies in that the current value Tc is preferably obtained by detecting the output value of the infrared sensor 106 on a predetermined time basis for a time in which the rotatable plate 104 is rotated once, while the initial value Ts is preferably obtained by detecting the output value of the infrared sensor 106 for a predetermined time period—preferably while the rotatable plate 104 is rotated twice—at a predetermined time basis.

After the current value Tc of the infrared sensor 106 is detected, the current value Tc is compared with the completion value Te.

If the current value Tc is less than the completion value Te, it is determined to which division of the three divisions D1, D2, and D3 the current value Tc falls (Step S16).

If it is determined that the current value Tc falls into the division D1, the power rate of the magnetron is adjusted at 40% (Step S17).

If it is determined that the current value Tc falls into the division D2, or D3, the power rate of the magnetron is adjusted at 20%, or at 10%, respectively (Steps S18 and S19).

Here, the power rate of the magnetron is expressed in percentage % to indicate the time when the magnetron is actually driven for a predetermined time period. More specifically, the power rate 40%, for example, means that the magnetron is periodically driven for 40% of the unit time period, while not driven for 60% of the unit time period.

As defrosting is performed, since the current value Tc of the infrared sensor 106 varies from the initial value Ts to the completion value Te, the current value Tc would pass through the three divisions D1, D2, and D3, sequentially.

Accordingly, the power rate of the magnetron is adjusted from 40% in the division D1, to 20% in the division D2, and to 10% in the division D3, sequentially.

Then the process returns to S14, from where the steps of S14, S15, S16, and S17 (or S18 and S19) are repeatedly performed until the current value Tc reaches the completion value Te.

If the current value Tc, which is compared with the completion value Te in S15, is equal to or greater than the completion value Te, it is determined that the defrosting process is completed, so that the process escapes the loop and the operation for defrosting process such as driving the magnetron, etc is stopped.

According to the preferred embodiment, although the power of the magnetron is set at 40%, 20%, and 10% for the three divisions D1, D2, and D3, respectively, it is not limited to this case only, but can be varied only if the power rate of the magnetron is decreased as the current value Tc gets closer to the completion value Te from the initial value Ts.

As described above, according to the present invention, since the defrosting method controls the defrosting process through the output value of the infrared sensor 106, which corresponds to the surface temperature of the food F, the accurate defrost can be performed regardless of the frozen degree of the food F and presence/absence of the receptacle for food F.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A thawing method for a microwave oven, comprising the steps of:

making a determination of an initial output value indicated by a sensor responsive to a surface temperature of food to be thawed;

determining a thawing process completion value based on the initial output value;

heating the food by driving a magnetron;

making a determination of a subsequent output value indicated by the sensor; and completing the thawing process when the output value indicated by the sensor reaches the thawing process completion value.

2. The thawing method of claim 1, further comprised of using an infrared sensor to indicate said surface temperature.

3. The thawing method of claim 2, further comprised of setting a detection range of said infrared sensor eccentrically with respect to the center of a rotatable tray bearing the food within the microwave oven.

4. The thawing method of claim 1, further comprised of setting a detection range of said sensor eccentrically with respect to the center of a rotatable tray bearing the food within the microwave oven.

5. The thawing method of claim 4, further comprised of making each said determination by selecting as the corresponding output value, a lowest value from among a plurality of output values indicated by said sensor during an interval of time comprised of a predetermined number of rotations of the rotatable tray bearing the food.

6. The thawing method of claim 5, further comprised of gradually changing the power driving the magnetron in inverse correspondence with said output value indicated by the sensor.

7. The thawing method of claim 4, further comprised of:

making said determination of the initial output value by selecting as the initial output value, a lowest value from among a plurality of output values indicated by said sensor during an interval of time comprised of two rotations of a rotatable tray bearing the food; and making said determination of each subsequent output value by selecting as the corresponding subsequent output value, a lowest value from among a plurality of the output values indicated by said sensor during an interval of time comprised of one rotation of the rotatable tray bearing the food.

8. The thawing method of claim 4, further comprised of gradually changing the power driving the magnetron in inverse correspondence with said output value indicated by the sensor.

9. The thawing method of claim 4, further comprised of:

making said determination of the initial output value by selecting as the initial output value, a lowest value from among a plurality of output values indicated by said sensor during an interval of time comprised of a first measure of rotation of the rotatable tray bearing the food with the microwave oven; and making said determination of each subsequent output value by selecting as the corresponding subsequent output value, a lowest value from among a plurality of the output values indicated by said sensor during an interval of time comprised of a second measure of said rotation.

10. The thawing method of claim 9, further comprised of gradually changing the power driving the magnetron in inverse correspondence with said output value indicated by the sensor.

11. The thawing method of claim 1, further comprised of making each said determination by selecting as the corresponding output value, a lowest value from among a plurality of output values indicated by said sensor during an interval of time comprised of a predetermined number of rotations of a rotatable tray bearing the food.

12. The thawing method of claim 11, further comprised of gradually changing the power driving the magnetron in inverse correspondence with said output value indicated by the sensor.

13. The thawing method of claim 1, further comprised of:

making said determination of the initial output value by selecting as the initial output value, a lowest value from among a plurality of output values indicated by said sensor during an interval of time comprised of two rotations of a rotatable tray bearing the food; and making said determination of each subsequent output value by selecting as the corresponding subsequent output value, a lowest value from among a plurality of the output values indicated by said sensor during an interval of time comprised of one rotation of the rotatable tray bearing the food.

14. The thawing method of claim 1, further comprised of gradually changing the power driving the magnetron while heating the food.

15. The thawing method of claim 1, further comprised of gradually changing the power driving the magnetron in inverse correspondence with said output value indicated by the sensor.

16. The thawing method of claim 1, further comprised of:

making said determination of the initial output value by selecting as the initial output value, a lowest value from among a plurality of output values indicated by said sensor during an interval of time comprised of a first measure of rotation of a rotatable tray bearing the food within the microwave oven; and making said determination of each subsequent output value by selecting as the corresponding subsequent output value, a lowest value from among a plurality of the output values indicated by said sensor during an interval of time comprised of a second measure of said rotation.

17. The thawing method of claim 16, further comprised of gradually changing the power driving the magnetron in inverse correspondence with said output value indicated by the sensor.

18. A thawing method for a microwave oven, comprising the steps of:

making a determination of an initial output value indicated by a sensor responsive to a surface temperature of food to be thawed, with said initial output value and each said subsequent output value being a lowest value selected from among a plurality of output values indicated by said sensor during intervals of time comprised of measures of rotation of the rotatable tray bearing the food with the microwave oven;

determining a thawing process completion value based on the initial output value;

heating the food by driving a magnetron;

making a determination of a subsequent output value indicated by the sensor; and completing the thawing process when the output value indicated by the sensor reaches the thawing process completion value.

19. A thawing method for a microwave oven, comprising the steps of:

making a determination of an initial output value indicated by a sensor responsive to a surface temperature of food to be thawed;

determining a thawing process completion value based on the initial output value;

heating the food by driving a magnetron;

making a determination of a subsequent output value indicated by the sensor, with each said subsequent output value being a lowest value selected from among a plurality of output values indicated by said sensor during an interval of time comprised of a second measure of rotation of the rotatable tray bearing the food with the microwave oven; and completing the thawing process when the output value indicated by the sensor reaches the thawing process completion value.

20. The thawing method of claim 19, further comprised of setting a detection range of said sensor eccentrically with respect to the center of a rotatable tray bearing the food within the microwave oven.

* * * * *